United States Patent [19]

Agren

[11] Patent Number: 5,060,735

[45] Date of Patent: Oct. 29, 1991

[54] DEVICE FOR POSITIONING OF A DRILL BIT

[75] Inventor: Nils Ågren, Sollentuna, Sweden

[73] Assignee: Atlas Copco Construction and Mining Technique AB, Stockholm, Sweden

[21] Appl. No.: 556,104

[22] Filed: Jul. 20, 1990

[30] Foreign Application Priority Data

Aug. 28, 1989 [SE] Sweden ..... 8902850
Oct. 20, 1989 [SE] Sweden ..... 8903472

[51] Int. Cl.[5] ..... E21B 7/00; E21B 47/02

[52] U.S. Cl. ..... 175/40; 175/45; 175/220; 33/1 H; 299/1; 173/20; 173/39

[58] Field of Search ..... 175/40, 45, 41, 24, 175/220, 62, 135, 162, 203; 299/1; 356/154, 399, 400; 33/1 H, 1 G, 1 CC, 308, 309, 311, DIG. 21; 173/20, 39

[56] References Cited

U.S. PATENT DOCUMENTS

| | | | |
|---|---|---|---|
| 3,891,039 | 6/1975 | Logerstrom | 175/40 |
| 4,027,210 | 5/1977 | Weber | 299/1 |
| 4,238,828 | 12/1980 | Hay et al. | 175/45 |
| 4,367,021 | 1/1983 | Nordgren et al. | 33/1 H |
| 4,506,745 | 3/1985 | Bjor | 175/45 |
| 4,639,868 | 1/1987 | Tanaka et al. | 33/1 H |
| 4,708,395 | 11/1987 | Petry et al. | 299/1 |

*Primary Examiner*—Bruce M. Kisliuk
*Attorney, Agent, or Firm*—Eric Y. Munson; Mark P. Stone

[57] ABSTRACT

Device for positioning of a drill bit (1) at a positioning plane (2). A drill rig (3) is provided with two video cameras (9) for sensing the position of a light source (8) adjacent the drill bit. The video cameras are aligned in parallel. The image fields of the video cameras are displaced such relative to each other that the light source gives two points (20,21) on a monitor (10) common to the two cameras if the light source is situated outside the positioning plane and one point (11) if the light source is situated in the positioning plane.

1 Claim, 3 Drawing Sheets

DEVICE FOR POSITIONING OF A DRILL BIT

BACKGROUND OF THE INVENTION

The present invention relates to a device for positioning of a drill bit at a positioning plane. This means that the drill bit or a point near the drill bit is manoeuvred such that it obtains a desired position in the positioning plane.

In existing rock drilling rigs the operator positions the drill bit by the eye. This results in a relatively high uncertainty at the positioning since the operator is far from the tunnel front and normally does not see the drill bit along the drill string. This means the the drill bit will be aligned towards a point to the side of the desired one if the drill bit if the drill bit is not positioned in a well defined lengthwise position. This uncertainty means that one has to take into account at the subsequent blasting that the drill holes are not in optimal positions. This gives as a result that an extra amount of explosives has to be used which makes the driving of the tunnel more expensive.

SUMMARY OF THE INVENTION

The present invention, which is defined in the subsequent claims, aims at achieving a device for positioning of the drill bit at a positioning plane, which makes sure that the different drill holes obtain positions which with great accuracy correspond to the desired drill plan.

BRIEF DESCRIPTION OF THE DRAWINGS

An embodiment of the invention is described below with reference to the accompanying drawings in which.

DESCRIPTION OF THE PREFERRED EMBODIMENT OF THE INVENTION

Figure 1:
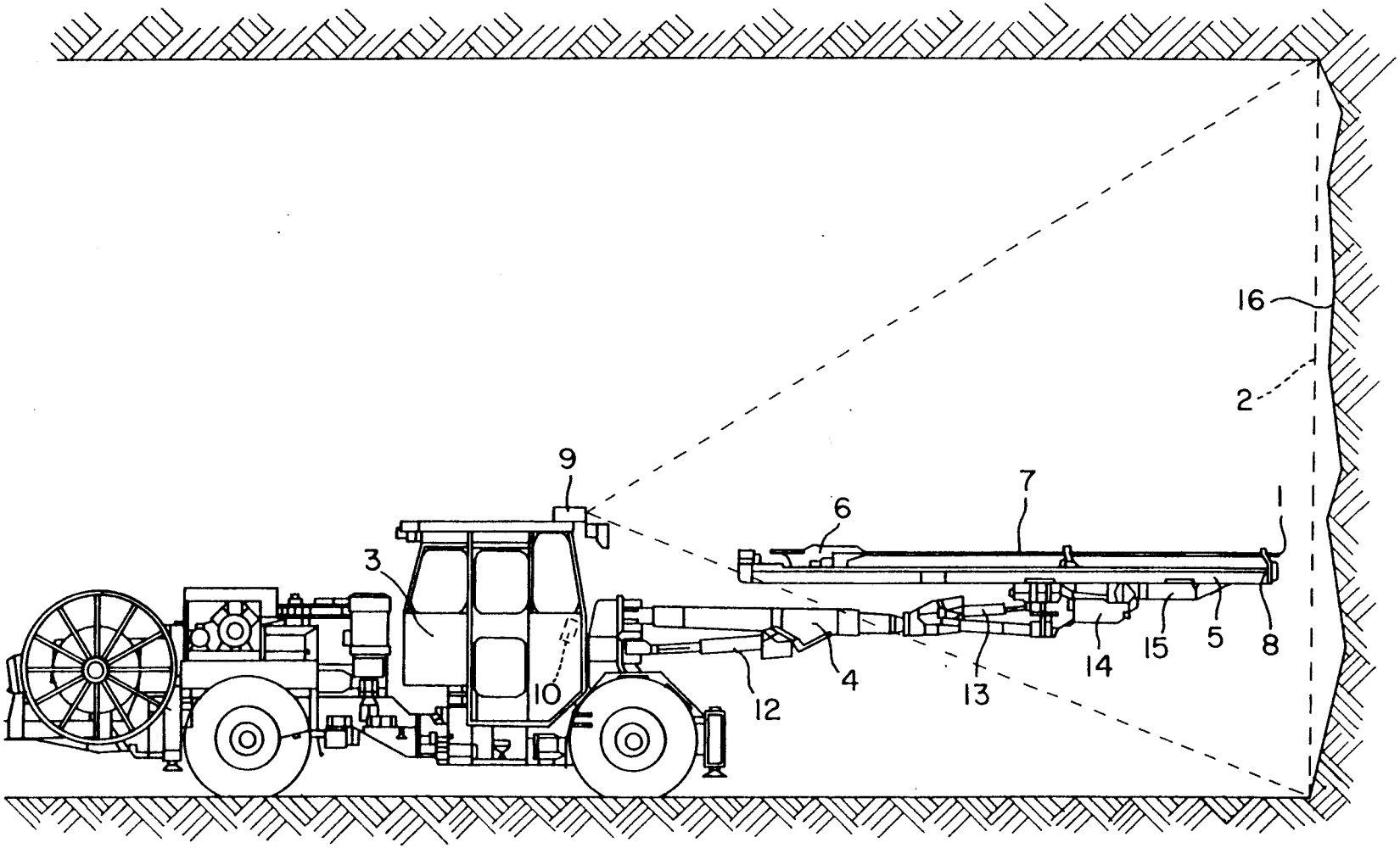
FIG. 1 shows a side view of a device according to the invention.
Figure 2:
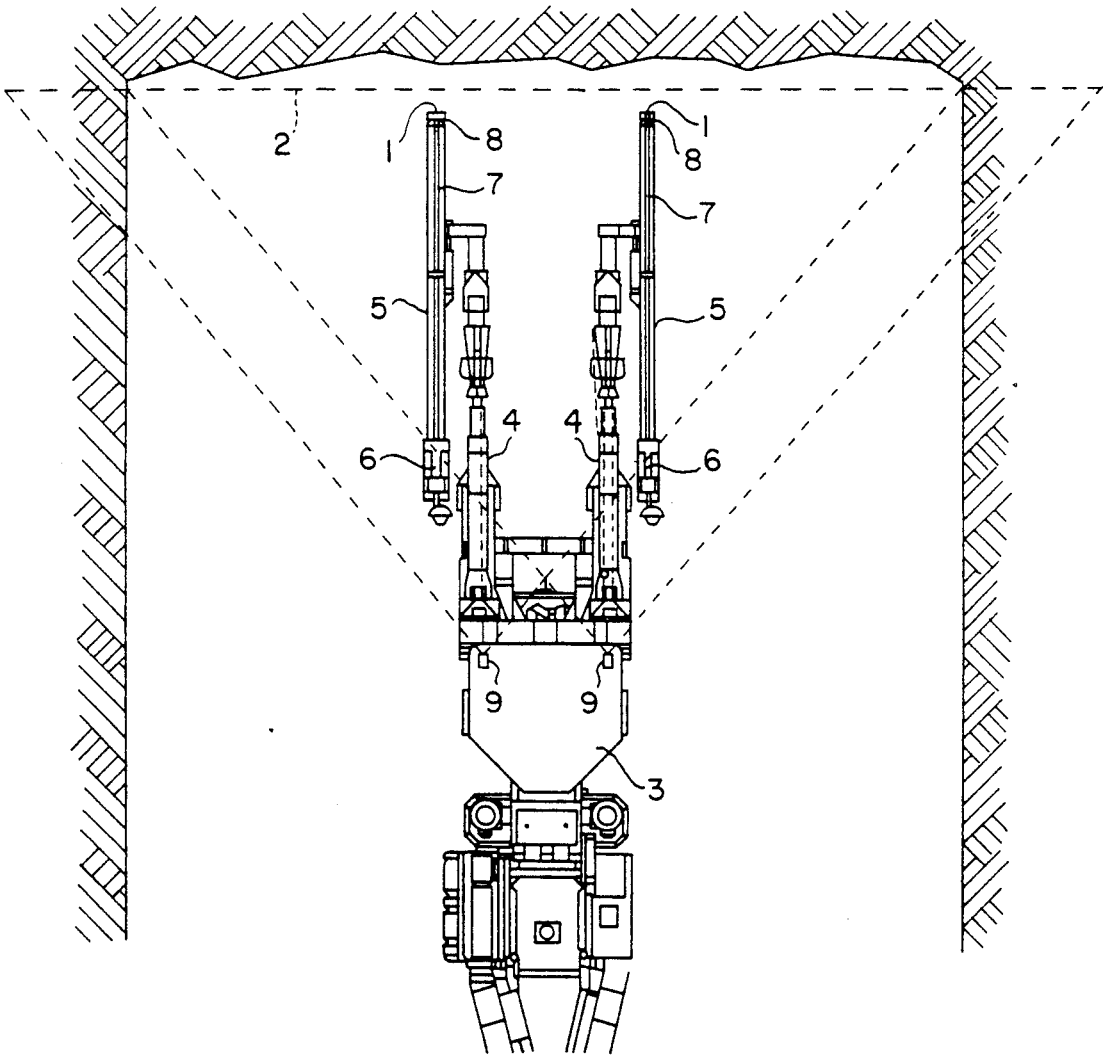
FIG. 2 shows a view from above of the device according to FIG. 1.
Figure 3:
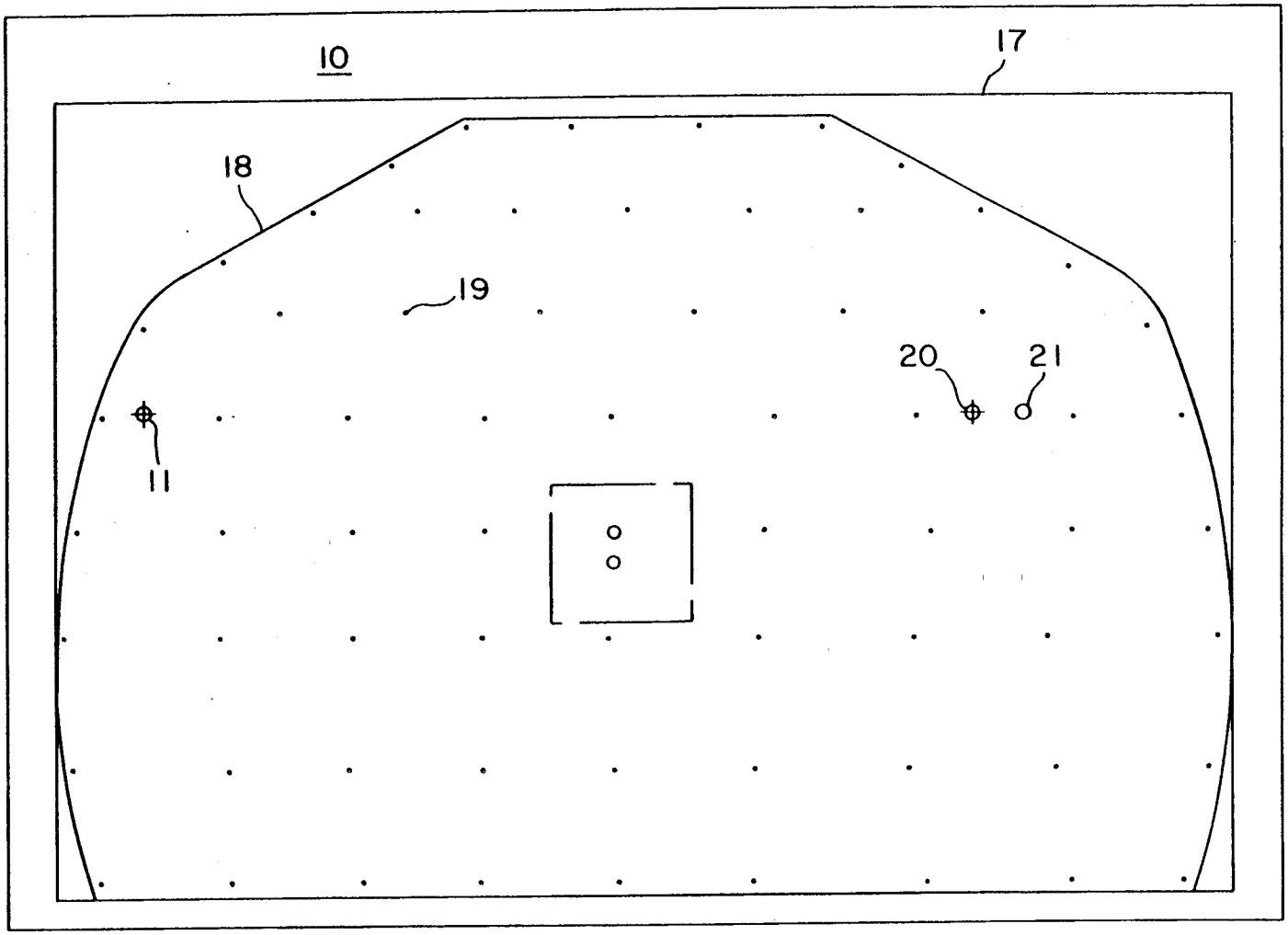
FIG. 3 shows a view of a monitor on which a drill plan has been marked.

The device shown in the drawings comprises a carrier in form of a vehicle 3 on which two drill booms 4 are swingably arranged. A feed beam 5 is swingably arranged on each drill boom 4. Drill boom and feed beam are swingable by means of hydraulic cylinders 12,13. The drill boom is at its front end provided with a boom head 14 which carries the feed beam 5. The feed beam is displaceable relative to the boom head by means of a hydraulic cylinder 15. A rock drilling machine 6 is displaceable to-and-fro along the feed beam 5. A drill string 7, which at its front end is provided with a drill bit, is connected to the rock drilling machine 6. The feed beam 5 is near the drill bit 1 provided with a marker 8. This marker can for instance comprise a light source, preferably for infrared light. Two video cameras 9 are arranged at a distance from each other on carrier 3 and are adjusted in parallel relative to each other and directed towards a tunnel front 16 in front of which a positioning plane 2 is situated. The two video cameras are connected to a common monitor 10 on which a drill plan 17 is placed. Suitably a transparent plastic film is used on which the contour 18 of the tunnel and the positions 19 of the different drill holes are marked. The two video cameras are suitably provided with filters which transmit infrared light only. As a result the operator does not get a lot of unnessary information on the screen which makes it easier to adjust the drill bit. When reproducing the image fields from the two video cameras the image fields are displaced relative to each other either electronically or through the objectives of one or both of the video cameras being displaced sideways relative to the camera housing such that a given point in the positioning plane 2 is reproduced on the screen of the monitor 10 as a single point by the two video cameras. This results therein that the marker 8 gives rise to two points 20,21 on the monitor if the marker 8 is not situated in the positioning plane 2 and one point when the marker is situated in the positioning plane. In order to adjust the drill bit correctly relative to the drill plan 17 hydraulic cylinders 12,13 and 15 are manoeuvred such that the two points 20,21 are made to coincide in one point 11 which should coincide with a drill hole position 19. When this has occured marker 8 is situated in the correct position in the positioning plane 2 with great accuracy. Drill plan 17 is somewhat modified relative to the desired drill hole pattern in order to take into consideration that the position of marker 8 does not coincide with the position of the drill bit. In order to get the drill string 7 in the correct direction for the drilling it is suitable to use angle sensors between carrier 3 and feed beam 5. These angle sensors may be placed at or in the different joints between carrier and feed beam or in another way indicate the direction of the feed beam relative to the carrier.

We claim:

1. Device for positioning of a drill bit (1) at a positioning plane (2), said device comprising a carrier (3), at least one drill boom (4) swingable relative to the carrier, a feed beam (5) swingable relative to the drill boom and carrying a rock drilling machine (6) movable to-and-fro along the feed beam, and a drill string (7) comprising said drill bit (1) connected to the rock drilling machine, characterized by a marker (8) arranged adjacent to said drill bit (1), two video cameras (9) arranged at a distance from each other on said carrier, and a monitor (10) for simultaneous reproductions of images from said video cameras, said video cameras being aligned in parallel, the image fields of the video cameras being displaced relative to each other such that a given point in the positioning plane is reproduced by both video cameras as a common point on the monitor, wherein said marker (8) causes one single point (11) on said monitor when the marker is situated in the positioning plane.

* * * * *